US012532932B1

(12) United States Patent
Jimenez

(10) Patent No.: US 12,532,932 B1
(45) Date of Patent: Jan. 27, 2026

(54) HEADWEAR WITH AIRFLOW CIRCULATION AND COOLING EFFECT

(71) Applicant: Juan Jimenez, Houston, TX (US)

(72) Inventor: Juan Jimenez, Houston, TX (US)

( * ) Notice: Subject to any disclaimer, the term of this patent is extended or adjusted under 35 U.S.C. 154(b) by 0 days.

(21) Appl. No.: 19/249,495

(22) Filed: Jun. 25, 2025

(51) Int. Cl.
*A42B 1/008* (2021.01)

(52) U.S. Cl.
CPC ..... *A42B 1/008* (2013.01)

(58) Field of Classification Search
CPC ..... A42B 1/008
See application file for complete search history.

(56) References Cited

U.S. PATENT DOCUMENTS 4,274,157 A * 6/1981 Boden ..... A42C 5/04 2/181.4
4,484,363 A 11/1984 Varanese
4,731,885 A 3/1988 Nava
5,163,425 A 11/1992 Nambu
5,337,421 A 8/1994 Jeng
5,839,121 A 11/1998 Morales
5,855,023 A * 1/1999 Clingenpeel ..... A42C 5/04 2/209.5
6,199,214 B1 * 3/2001 Campbell ..... A42C 5/02 2/181.8
6,243,876 B1 6/2001 Provenzano
6,367,084 B1 4/2002 Keast
6,370,697 B1 * 4/2002 Held ..... A42C 5/04 2/184.5
10,085,511 B2 * 10/2018 Crunk ..... A42C 5/04
10,524,529 B2 * 1/2020 Muskovitz ..... A42B 3/283
11,131,310 B1 9/2021 Emery
11,278,075 B1 * 3/2022 Wood ..... A42B 1/0183
11,602,189 B2 * 3/2023 Greenberger ..... A42B 1/24
11,974,627 B2 * 5/2024 Walker ..... A42C 5/04
2004/0210983 A1 10/2004 Early
2004/0231033 A1 * 11/2004 Cho ..... A42B 1/0182 2/195.1
2006/0230506 A1 * 10/2006 Shirai ..... A42B 3/281 2/410
2008/0163406 A1 * 7/2008 Solari ..... A42B 1/22 2/195.3
2009/0241240 A1 * 10/2009 Han ..... A42C 5/04 2/209.3
2013/0263358 A1 * 10/2013 Fleischmann ..... A42B 1/008 2/184.5

(Continued)

FOREIGN PATENT DOCUMENTS

GB 2426428 A 11/2006

*Primary Examiner* — Khaled Annis
(74) *Attorney, Agent, or Firm* — EGBERT, MCDANIEL & SWARTZ, PLLC

(57) ABSTRACT

A headwear has a crown adapted to fit upon a head of a wearer, a visor affixed to the crown so as to extend forwardly of the crown, and an insert member affixed to the crown. The insert member has an airflow port formed therein. The airflow port adapted to allow air to flow to an interior the crown and to circulate over the head of the wearer. The insert member has a spacer portion arranged at an interior of the crown so as to space the crown from the head of the wearer. The insert member includes a front insert member positioned at a forward portion of the crown and a back insert member positioned at a rearward portion of the crown.

17 Claims, 6 Drawing Sheets

(56) References Cited

U.S. PATENT DOCUMENTS

| | | | | |
|---|---|---|---|---|
| 2015/0000008 | A1* | 1/2015 | Shirai | A42B 1/008 2/195.1 |
| 2015/0020292 | A1 | 1/2015 | Diaz | |
| 2016/0000172 | A1* | 1/2016 | Cho | A42B 1/0182 2/181 |
| 2016/0007672 | A1* | 1/2016 | Ku | A42B 1/008 2/171.3 |
| 2018/0007993 | A1 | 1/2018 | Moreno | |
| 2019/0150551 | A1* | 5/2019 | Clark | A42B 1/0182 |
| 2020/0138140 | A1* | 5/2020 | Shapiro | A42B 3/285 |

* cited by examiner

HEADWEAR WITH AIRFLOW CIRCULATION AND COOLING EFFECT

CROSS-REFERENCE TO RELATED APPLICATIONS

Not applicable.

FIELD OF THE INVENTION

The present invention relates to headwear. More particularly, the present invention relates to headwear in the nature of baseball caps. Additionally, the present invention relates to such headwear having airflow circulation therein.

BACKGROUND OF THE INVENTION

Baseball caps and similar cap and hats conventionally are provided with a crown having a front peak. The cap is provided with an adjustable headband to facilitate versatility in size fitment. The cap is usually open to some extent at the rear thereof in the occipital region. It may also have an air permeable area provided by a meshwork fabric so as to give a measure of ventilation to the scalp.

Caps of this kind are worn principally during the summer season with the intention of affording protection to the wearer from the heat and glare of the sun. However, a practical disadvantage of currently available caps is that they fit in relatively close proximity to the scalp. This tends to generate heat. This problem can be especially acute for wearers who have experienced hair loss on the crown. Excessive perspiration results to the extent that the cap needs to be removed. Therefore, this defeats the object of wearing such caps.

Conventional caps have been primarily used to shade the wearer from the sun and its heat. Such caps are mostly used for outdoor sports such as baseball, running, tennis, etc. However, such caps have also become a fashion statement and have indicia formed therein indicative of sponsors or corporations. As such, the names or logos can be placed on the front of the caps.

The primary elements of a standard baseball cap included crown and visor. The crown is composed from multiple panels (also referred to as "gore sections") that are sown together to form a generally hemispherical top cover that covers the head of the wearer. The visor extends in an outward direction from the front area of the crown and provides shade and insulation for the head and face of the wearer. A wide range of materials, natural or synthetic, may be used to form the baseball cap.

Over the last few decades, the humble cap has evolved and is now manufactured from a wide range of materials. Accessories include VELCRO™, metal clasps or plastic claps that allow for manufacturing of a "one-size-fits-all" cap. Some designs even have rear panels made completely of plastic. The front panels can be made from composite fabric fibers.

The drawback of all these prior designs is that none of them address the combination of shade and air circulation, or lack thereof, within the cap. In a warm world where record high temperatures are part of everyday life, the cap designs exacerbate the problem for the wearer. The complete cloth design encapsulates the heat generated by the head of the wearer and causes a micro-greenhouse effect. The plastic mesh design foregoes the shade for the sake of air circulation through the holes.

Various patents and patent application publications have issued with respect to caps employing air circulation and cooling systems. An early patent is that of U.S. Pat. No. 4,484,363, issued on Nov. 27, 1984 to T. E. Varanese. This patent describes a combination hat and cooling device. The cooling device is removably mounted to a front inside portion of the hat. The device includes an enclosure defined by an inverted pocket adapted to receive and store a sealed container filled with a coolant so as to provide a cooling effect to the forehead and general area of the frontal portion of the wearer's head.

U.S. Pat. No. 4,731,885, issued on Mar. 22, 1988 to P. L. Nava, describes a device for dividing the airflow entering into a helmet into a central upward flow and a pair of lateral flows. The entry of the lateral airflows can be adjusted by means of a hinged valve made of flexible plastic material. The hinged ends of the valve are oriented toward the centerline of the helmet. The valves are shifted by sliders engaging with an inclined plane of the valve.

U.S. Pat. No. 5,163,425, issued on Nov. 17, 1992 to Nambu et al., discloses a deformable cap for scalp cooling. The cap contains a cap member obtained by discharging air inside a hollow ball formed of a plastic material and a plurality of small pieces of high water content hydrogel contained in the cap member. The hydrogel is prepared by casting an aqueous solution of polyvinyl alcohol into a mold, cooling the cast aqueous solution to a low temperature in order to obtain a cooled frozen mass, and then thawing the cooled frozen mass into additional cooling and thawing operations.

U.S. Pat. No. 5,337,421, issued on the Aug. 16, 1994 to Y. M. Jeng, teaches a cyclist helmet having a molded helmet body defining a recessed interior for receiving the head of the cyclist and a tail portion through which air passages are formed with a first opening on the top surface of the helmet and a second opening located on the underside of the tail portion of the helmet so as to allow air to flow therethrough. This creates a negative pressure zone under the tail portion which provides a suction to exhaust the air inside the helmet's interior. A fastening strip is provided to secure the helmet onto the head of the cyclist.

U.S. Pat. No. 5,839,121, issued on Nov. 24, 1998 to L. O. L. Morales, provides a cooling cap or helmet containing several air funnels which ventilate a scalp during a sports activity. The air funnels have downward flow through apertures or through ducts. The flexible funnels can be removed for cleaning or replacement.

U.S. Pat. No. 6,243,876, issued on Jun. 12, 2001 to Provenzano et al., teaches a venting headwear containing at least one aperture in the material of the cap. This aperture is flanked by a set of differently shaped and sized flaps. This creates circulation of air through the wearer's hair and scalp during activity involving motion and windy conditions. The airflow creates a cooling effect and prevents perspiration from wetting the scalp and forehead.

U.S. Pat. No. 6,367,084, issued on Apr. 9, 2002 to Keast, discloses headwear in the form of a baseball cap. This headwear has an inlet aperture in its front portion which is associated with a baffle. In use on the wearers' head, mildly turbulent airflow is induced into the cap space by virtue of the baffle. This creates a cooling effect upon the wearer's head.

U.S. Pat. No. 11,131,310, issued on Sep. 28, 2021 to E. D. Emery, shows an airflow assembly with a lightweight airflow mechanism that can be easily mounted on various types of headwear. The airflow assembly can be mounted onto the headwear in order to be permanent thereto or releasable therefrom.

U.S. Patent Application Publication No. 2004/0210983, published on Oct. 28, 2004 to C. A. Early, discloses a ventable ski hat for enabling a skier to selectively vent body heat. The ventable ski hat has a superficial insulative fabric layer, a deep moisture-wicking fabric layer, a zipper structure, a mesh fabric layer, and an insulative headband member. The superficial fabric layer and the deep fabric layer define a superior vent portion and an inferior crown-receiving portion. The superior vent portion has an anterior-superior portion, a posterior-superior portion and a selectively-ventable vent aperture. The zipper structure is located at the vent aperture for selectively venting the vent aperture. The zipper structure is medially aligned along a wearer's head adjacent to the wearer's superior head surface so as to define an insulative air layer.

U.S. Patent Application Publication No. 2015/0020292, published on Jan. 22, 2015 to Diaz et al., discloses headwear having insulated ventilation channels and perspiration and moisture drainage channels. This headwear has top insulated ventilation channels with front insulation openings and rear ventilation openings. Insulated side walls are provided with side ventilation openings. A rim is embedded with a perspiration and moisture drainage channel. Air circulates between the front and back of the top of the headwear through insulated ventilation channels in order to aid in the removal of excess moisture and heat from the top of the wearer's head. Insulated side walls with ventilation holes aide the removal of excess moisture and heat from the sides of the wearer's head.

U.S. Patent Application Publication No. 2018/0007993, published on Jan. 11, 2018 to J. Moreno, shows a ventilated helmet assembly for cooling a user when the user wears a helmet. The ventilation unit is coupled to the helmet. The ventilation unit urges air inwardly and outwardly from the helmet. The ventilation unit cools the user when the user wears the helmet.

U. K. Patent Application No. GB 2,426,428, published on Nov. 29, 2006 to K. Gammampila shows ventilated headwear that is a space between the headwear and the user's head, along with a means to communicate fresh air into or out of the space so as to ventilate the headwear and increase the comfort to the user. The headwear has openings on the exterior of the headwear and channels to facilitate the passage of air from the underside of the headwear to the space between the wearer's head and the headwear. The communication channels are located continuously or in clusters around the circumference of the head. Air enters the channels and passes through the space and out to the ventilated openings of the crown of the headwear.

It is an object of the present invention provide a headwear that provide has a cooling effect on the head of the wearer.

It is another object of the present invention to provide a headwear that promotes airflow circulation and evaporation.

It is another object of the present invention to provide a headwear that provides shade.

It is another object of the present invention to provide a headwear that has a crisp appearance.

It is a further object of the present invention provide a headwear that minimizes wrinkles in the crown of the headwear.

It is a further object of the present invention to provide a headwear that allows space for air circulation around the head of the wearer.

It is another object of the present invention to provide a headwear that prevents insect intrusion into the interior of the headwear.

It is a further object of the present invention to provide a headwear that creates a wind tunnel effect on the head of the wearer.

It is another object of the present invention provide a headwear that is comfortable.

It is a further object of the present invention to provide a headwear that is customizable.

It is still a further object of the present invention to provide a headwear that is easy to use, easy to manufacture and relatively inexpensive.

These and other objects and advantages of the present invention will become apparent from a reading of the attached specification and appended claims.

SUMMARY OF THE INVENTION

The present invention is a headwear that comprises a crown adapted to fit upon a headwear, a visor affixed to the crown so as to extend forwardly of the crown, and an insert member affixed to the crown. The insert member has an airflow port formed therein. The airflow port is adapted to allow air to flow into an interior of the crown and to circulate over the head of the wearer. The insert member has a spacer portion arranged at an interior of the crown so as to space the crown from the head of the wearer.

The insert member is positioned at a forward portion of the crown. The insert member can include a front insert member positioned at a forward portion of the crown and a back insert member positioned at a rearward portion of the crown. Each of the front insert member and the back insert member has an airflow port formed therein. The airflow port at the forward portion of the crown has a larger area than an area of the airflow port at the rearward portion of the crown. Each of the front insert member and the back insert member is covered with a cloth. This cloth exposes the airflow port of the front insert member and the back insert member. The insert member can be formed of a plastic or polymeric material.

In an embodiment of the present invention, the insert member has a cover thereon. This cover is movable between an open position and a closed position. The cover of the insert member defines an opening in the open position. The opening communicates with the interior of the crown and is adapted allow air flow to pass towards the head of the user. The cover can be connected to the insert member with hinges, joints or snaps. A screen can be connected the cover of the insert member so as to extend across the opening when the cover is in the open position. This screen can be detachably affixed to the cover of the insert member.

In an embodiment of the present invention, the cover of the insert member is triangular-shaped with a wide end positioned adjacent to the visor. The cover covers the airflow port when in the closed position. In an alternative embodiment of the present invention, the cover of the insert member can have a generally rectangular shape that covers at least a portion of the airflow port of the insert member in the closed position.

In another embodiment of the present invention, the insert member has the airflow port at or adjacent to the visor. The airflow port allows air to enter the interior of the crown. This insert member of this alternative embodiment has a generally triangular-shaped or funnel-shape with a wide end at the visor and a narrow end approaching a top of the crown. Specifically, in an embodiment, the visor can have a plurality of holes formed therethrough. The plurality of holes open to the wide bottom of the insert member. The plurality of holes allow air to enter the interior of the crown through the insert member from a bottom of the visor. Alternatively, the insert member can have a plurality of holes formed at or adjacent to the bottom of the insert member. This plurality of holes is adapted to allow air to enter the interior of the crown from the bottom of the insert member and above the crown.

The crown can have a vent formed at a back of the crown. This vent opens to the interior of the crown. The vent can be formed of a netting material.

The present invention is a headwear that incorporates a system that promotes air flow and evaporation so as to have a cooling effect on the head of the wearer. The headwear is in the nature of a cap, such as a baseball cap. This cap is composed of a crown cover and a visor. The crown cover will rest on the top of the wearer's head in a generally tight conforming semi-spherical shape. The present invention allows for shade, air flow and space for evaporation to occur by creating an opening on the front of the cap next to the wearer's forehead.

In one version of the in the first embodiment of the present invention, this opening is created by allowing a portion of the front of the cap to swing upwardly so as to create a secondary visor. Similarly, a smaller port can be created at the rear of the cap. These ports are formed of inserts that are covered by cloth. These inserts promote a crisp appearance in the cap so as to minimize wrinkles and further allow space for air circulation by creating a wind tunnel effect in the space between the interior surface of the cap and the head of the wearer. The ports can be propped open using articulated joints, hinges, or a snap system.

In the alternative embodiment, air is induced into the cap from openings formed underneath the visor and/or on top of the visor. Air will flow through a duct which can have perforations or slits that connect to the front of the cap. The cap has an opening to accept the duct. Air will arrive at the wearer's forehead and flow through the crown of the cap so as to promote evaporation and cooling.

This foregoing Section is intended to describe, with particularity, the preferred embodiments of the present invention. It is understood that modifications to this preferred embodiment can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
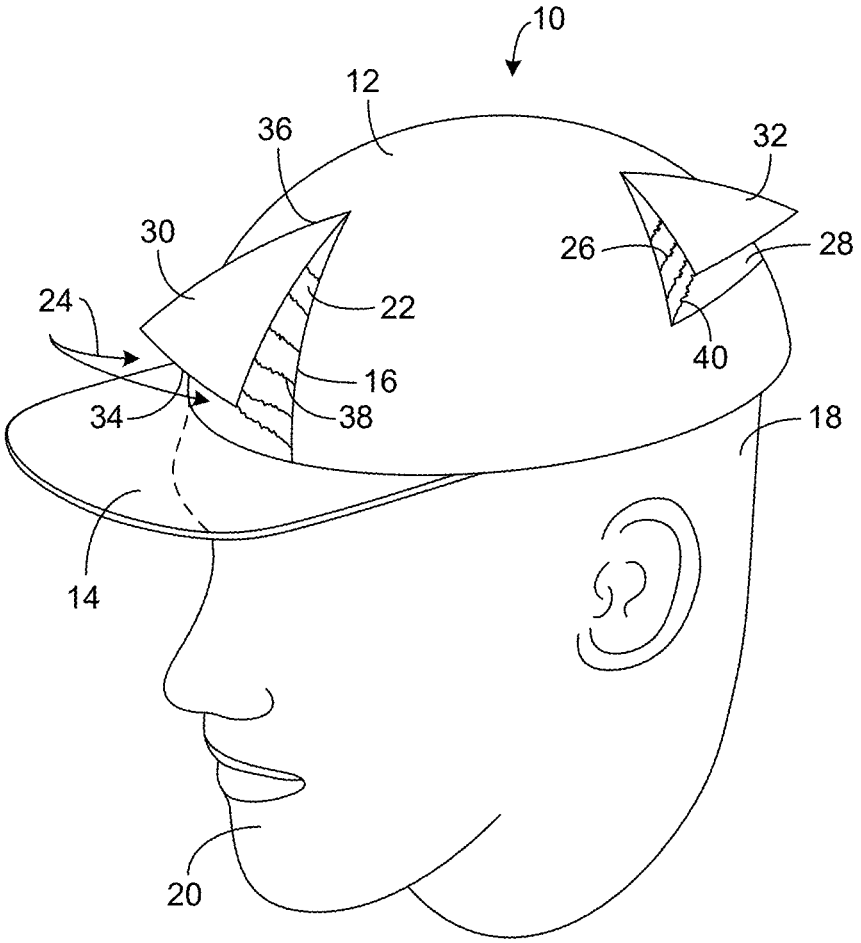
FIG. 1 is an upper perspective view showing the headwear of the present invention as placed upon a head of a wearer.

FIG. 1 shows the headwear 10 in accordance with an embodiment of the present invention. Headwear 10 includes a crown 12, a visor 14 and an insert member 16. The crown 12 is adapted to fit upon the head 18 of the wearer 20. The visor 10 is affixed to the crown 12 so as to extend forwardly of the crown 12. The insert member 16 is affixed to the crown 12. The insert member 16 has an airflow port 22 formed therein. This airflow port 22 is adapted to allow air to flow to an interior of the crown and to circulate over the head 18 of the wearer 20. As will be described hereinafter, the insert member 16 will have a spacer portion arranged at the interior of the crown 12 so as to space the crown 12 from the head 18 of the wearer 20. Air flow into the airflow port 22 of the insert member 16 is illustrated by arrows 24.

The insert member 16 is affixed at a forward portion of the crown 12. In the embodiment shown in FIG. 1, the insert member 16 also includes a back insert member 26. Insert member 16 is positioned at the forward portion of the crown 12. The back insert member 26 is positioned at a rearward portion of the crown 12. The back insert member 26 will also have an airflow port 28 formed therein. It can be seen that the airflow port 22 of the front insert member 16 has a larger area than an area the airflow port 28 of the back insert member 26.

In FIG. 1, the front insert member 16 is covered by a cloth 30. Similarly, the back insert member 26 is covered by a cloth 32. The cloth 30 exposes the airflow port 22 of the front insert member 16. The cloth 32 exposes the airflow port 28 of the back insert member 26.

FIG. 1 shows that the cover 30 is movable between an open position and a closed position. The open position is shown in FIG. 1. Similarly, the cover 30 of the airflow port 28 of the back insert member 26 is also movable between an open position and a closed position. The cover 30 of the front insert member 16 defines an opening 34 when the cover 30 is in the open position. This opening 30 will communicate with the interior of the crown 12 and be adapted to allow air flow to pass toward the head 18 of the wearer 20. FIG. 1 shows that the cover 30 is connected to the crown 12 by joints, hinges or snaps 36. The cover 32 is also connected to the crown 12 or to the back insert member 26 by such joints, hinges or snaps.

A screen 38 is connected to the cover 30 of the insert member 16 so as to extend across the opening 34 and the airflow port 22 to extend across the opening 34 when the cover 30 is in the open position. Similarly, the back insert member 26 includes a screen 40 that extends between the insert member 26 or the crown 12 and the cover 32. This screen 40 will also cover the opening defined between the cover 32 and the airflow port 28 of insert member 26 when the cover 32 is in the open position. Screens 38 and 40 are adapted to prevent insects or other undesirable elements from entering the interior of the crown 12 of the headwear 10. The screens 38 and 40 can be detachable from their connection between the insert member 16 and the cover 30 from the attachment between the insert member 26 and the cover 32.

In normal use and during normal activity, air flow will enter through the opening 34 of the front insert member 16 and pass through the space between the cover 30 and the forehead 18 of the wearer 20. The air flow will flow through the interior of the crown 12 so as to exit through the opening 28 between the cover 32 and the back insert member 26. This airflow circulation will create the cooling effect upon the head 18 of the wearer 20. Because the airflow port of the front insert member 16 is larger than the airflow port 28 of the back insert member 26, a Venturi-type of effect is created by this airflow. As such, the speed of airflow circulation increases as it passes from the front of the crown 12 toward the back of the crown 12.

Figure 2:
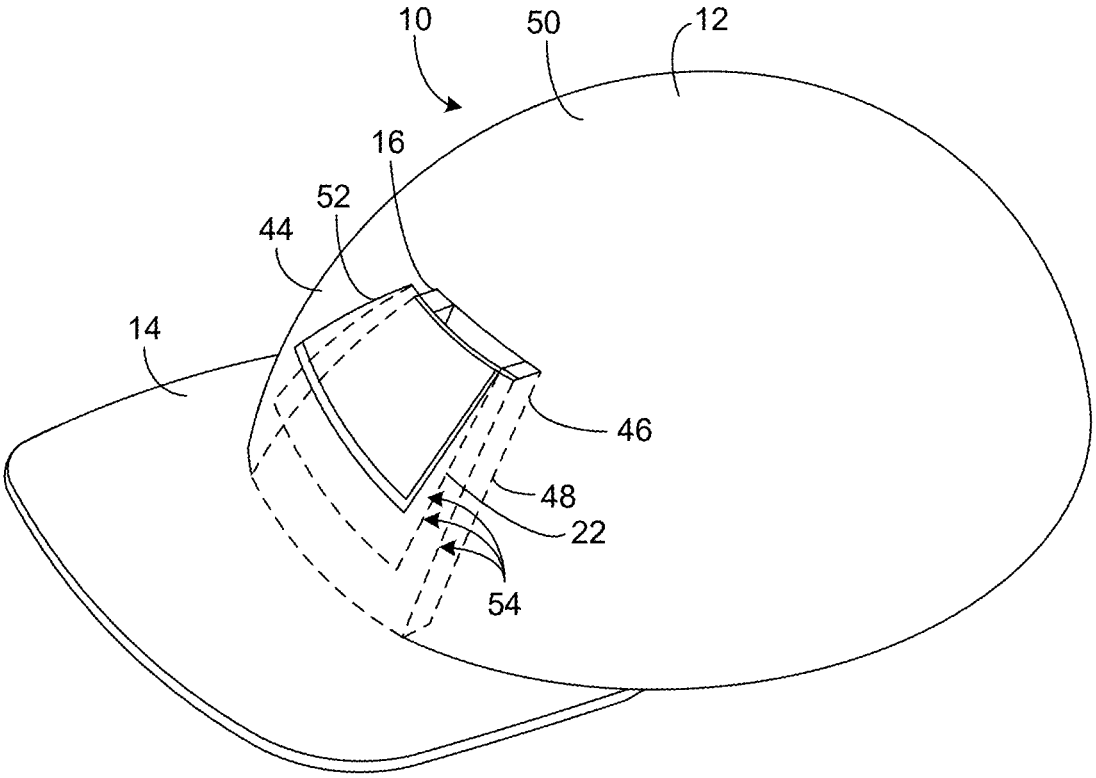
FIG. 2 is an upper perspective view of the headwear of the present invention showing, in particular, an alternative form of the insert member.

FIG. 2 shows an isolated configuration of the front insert member 16 as applied to the forward portion 44 of the crown 12 of headwear 10. Insert member 16 has a generally rectangular configuration. This insert member can be formed of a polymeric, elastomeric, or similar material. The surface 46 of the front insert member 16 will generally bear against the forehead of the wearer. A protruding portion 48 extends outwardly so as to provide a space between the inner surface of the crown 12 and the forehead of the wearer. The insert member 16 will have a generally rectangular configuration that extends from the visor 14 in order to generally approach the top 50 of the crown 12.

In FIG. 2, can be seen that the front insert member 16 has an airflow port 22 formed therein. The cover 52 has a generally rectangular configuration so as to cover at least a portion of this airflow port 22. FIG. 2 shows that there are separate airflow ports 54 that can be utilized in association with the front insert member 16. In other words, the airflow ports 54 can be configured to be larger or smaller. The cover 52 can be configured to cover the entirety of such airflow ports 54 or a portion of the airflow ports 54. The cover 52 can be joined to the front insert member 16 with an articulated joint, hinge or snap system.

Figure 3:
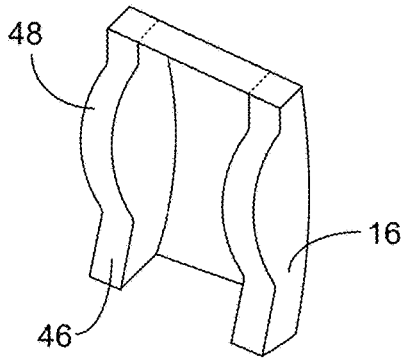
FIG. 3 is an isolated upper perspective view of the insert member of the present invention.

FIG. 3 shows an isolated view of the insert member 16. The insert member 26 can also have a configuration similar to that of the front insert member 16. Front insert member 16 includes the surface 46 facing the forehead of the user. The protruding portion 48 bears against the forehead of the user so as to appropriately space the crown 12 from the head of the wearer in order to provide an attic-type air space between the interior of the crown 12 and the head of the wearer. The use of the protruding portion 48, individually, or in association with the insert member 16, can further provide a crisp and tight appearance to the crown 12 because of this spacing and/or stretching effect. The spacing between the head of the wearer and the interior of the crown 12 is important so as to achieve a proper airflow between the air flow port 22 of the front insert member 16 and the airflow port 28 of the rear insert member 26.

Figure 4:
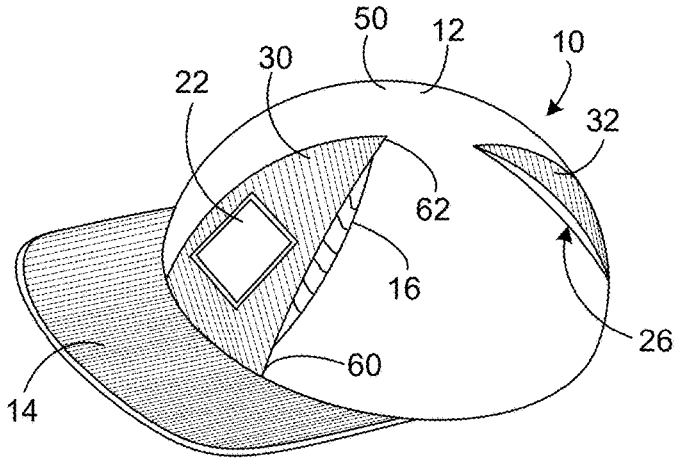
FIG. 4 is an upper perspective view of the headwear of the present invention showing the cover applied to the insert member.

FIG. 4 shows the front insert member 16 and the rear insert member 26 as applied to the crown 12 of the headwear 10. The cover 30 is illustrated as extending over the airflow port 22. Similarly, the cover 32 is illustrated as extending over the airflow port 28 at the back of the crown 12 of headwear 10. The cover 30 is illustrated as extending from the visor 14 to an area adjacent to the top 50 of the crown 12. The covers 30 and 32 are illustrated as having a generally triangular configuration with a wide end 60 adjacent to the visor 14 and a narrow end 62 adjacent to the top 50 of the crown 12.

Figure 5:
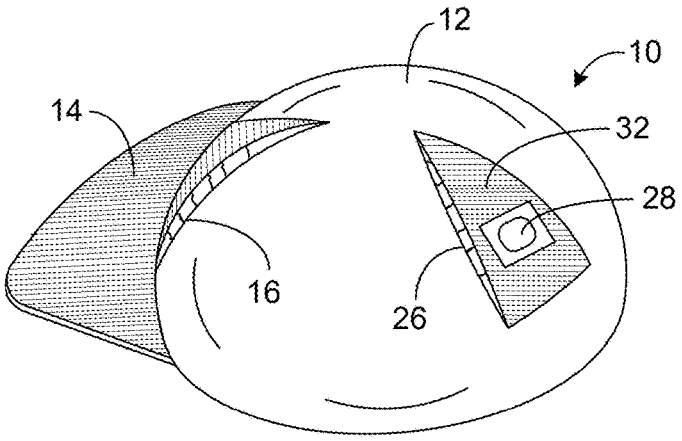
FIG. 5 is a rear upper perspective view of the headwear of the present invention showing the cover as applied to the headwear.

FIG. 5 also shows the headwear 10 from a rearward view. The front insert member 16 is illustrated at the forward portion of the headwear 10 generally adjacent to the visor 14. The rear insert member 26 is formed at a rearward portion of the headwear 10. FIG. 5 shows that there is an airflow port 28 formed at the rearward portion of the crown 12. Cover 32 will extend over the airflow port 28. The crown 12 is generally in the nature of a conventional baseball cap. The material of the crown 12 can be formed of cloth with micro-holes therein so as to further enhance airflow circulation.

Figure 6:
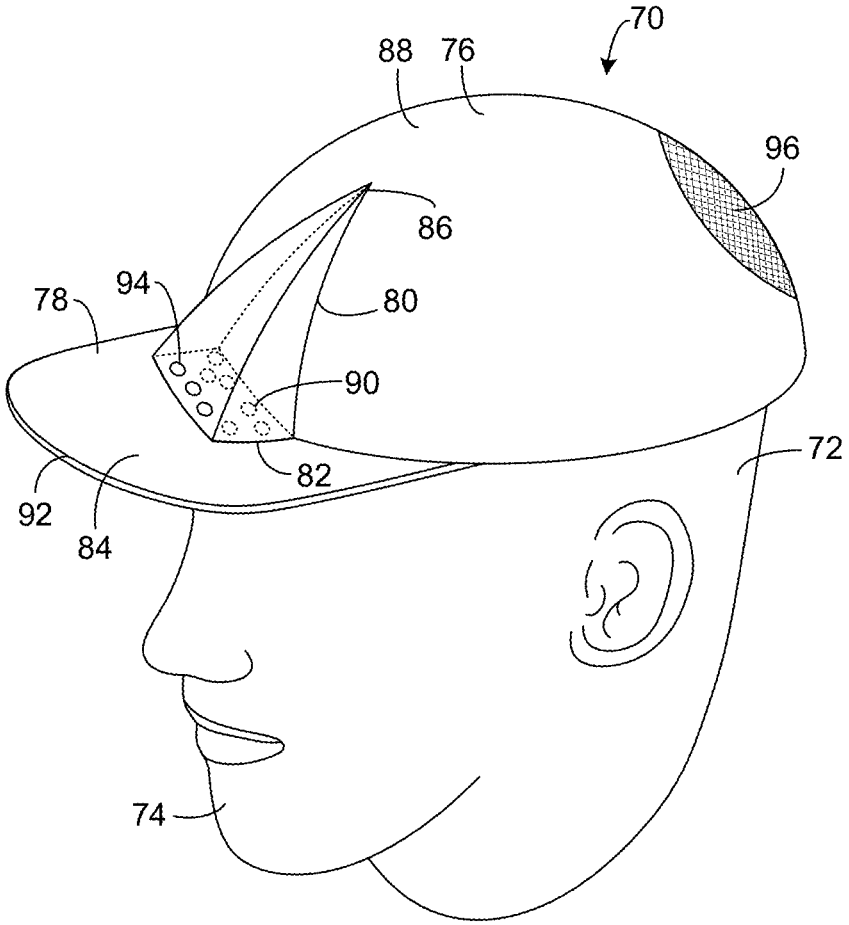
FIG. 6 is an upper perspective view of an alternative embodiment of the headwear of the present invention is applied to a head of a wearer.

FIG. 6 shows an alternative embodiment of the headwear 70 of the present invention. FIG. 6 shows that the headwear 70 is applied to the head 72 of the wearer 74. Headwear 70 includes a crown 76 and a visor 78 in the nature of conventional baseball caps. However, FIG. 6 shows that there is a front insert member 80 that is formed in the nature of a scoop or funnel. Front insert member 80 has one end 82 applied to the top surface 84 of the visor 78 and an upper end 86 that is adjacent to the top 88 of the crown 76. The insert member 80 will narrow in width from the bottom 82 toward the top 86 in order to promote the Ventori effect.

With reference to FIG. 6, it is important to note that air must enter the front insert member 80. This is achieved by providing a plurality of holes 90 through the visor 78. Holes 90 will open to an underside 92 of the visor 78. As such, after air flow hits the face of the wearer 74, it can flow upwardly through the plurality of holes 90 and through the insert member 84 and into the interior of the crown 76. The reduction in thickness and width of the insert member 80 also serves to create a Venturi effect so as to enhance airflow velocity through the space between the interior of the crown 76 and the head 72 of the wearer. 74.

FIG. 6 further shows that there are a plurality of holes 94 formed adjacent to the bottom 82 of the insert member 80. As such, air flow across the top of the visor 78 can pass into the holes 94 and into and through the insert member 80 and, therefore, through the interior of the crown 76 of headwear 70. The insert member 80 can include an interior surface (such as that shown hereinbefore) so as to properly space the headwear from the head 72 of the wearer 74.

A netting material 96 is provided as the insert member at the back of the headwear 76. This netting material 76 is in the nature of a screen that allows air to flow from the front insert member 80, through the interior of the crown 76, and outwardly through the screen 76. The netting 96 of the screen serves to prevent insects from entering the interior of the crown 76.

Figure 7:
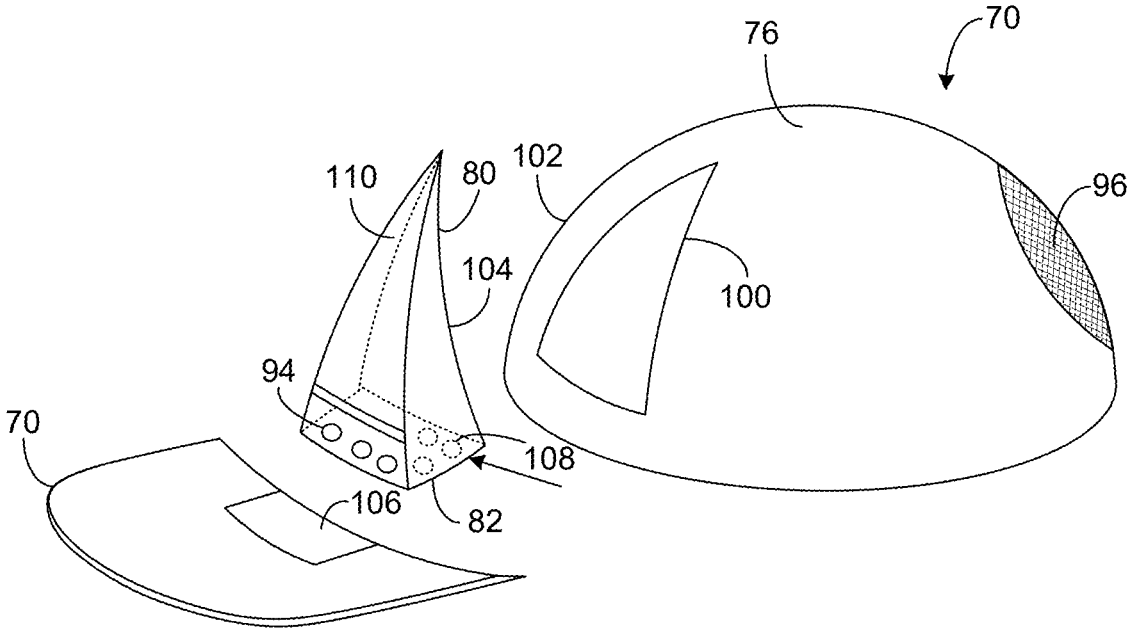
FIG. 7 is an upper perspective exploded view of the headwear of this alternative embodiment of the present invention.

FIG. 7 is an exploded view of the headwear 70 of this alternative embodiment of the present invention. In particular, FIG. 7 shows the crown 76 as separated from the visor 78. The insert member 80 is also illustrated as separated from the visor 78 and the crown 76. The crown 76 is illustrated as having an opening for a duct 100 formed on the forward surface 102 of the crown 76. The insert member 80 can be applied over this opening or duct 100. It can be seen that the back side 104 of the insert member 80 is open so as to correspond with the opening or duct 100 on the crown 76.

The visor 78 includes a surface 106 so as to receive the bottom 82 of the insert member 80. The surface 106 can be closed or it can have the plurality of holes 90 formed therein. FIG. 7 shows that the insert member 80 has the plurality of holes 108 formed at the bottom 82. Another plurality of holes 94 are formed adjacent to the bottom 84 at a forward surface 110 of the insert member 80. As stated previously, air can enter the insert member 80 through the plurality of holes 108 at the bottom 82 of the insert member 80 and/or the air can enter through the plurality of holes 94 at the forward surface 110 of the insert member 110. This air can then flow through the opening or duct 100 and through the interior of the crown 76 of the headwear 70 so as to ultimately escape through the rear vent 96.

Figure 8:
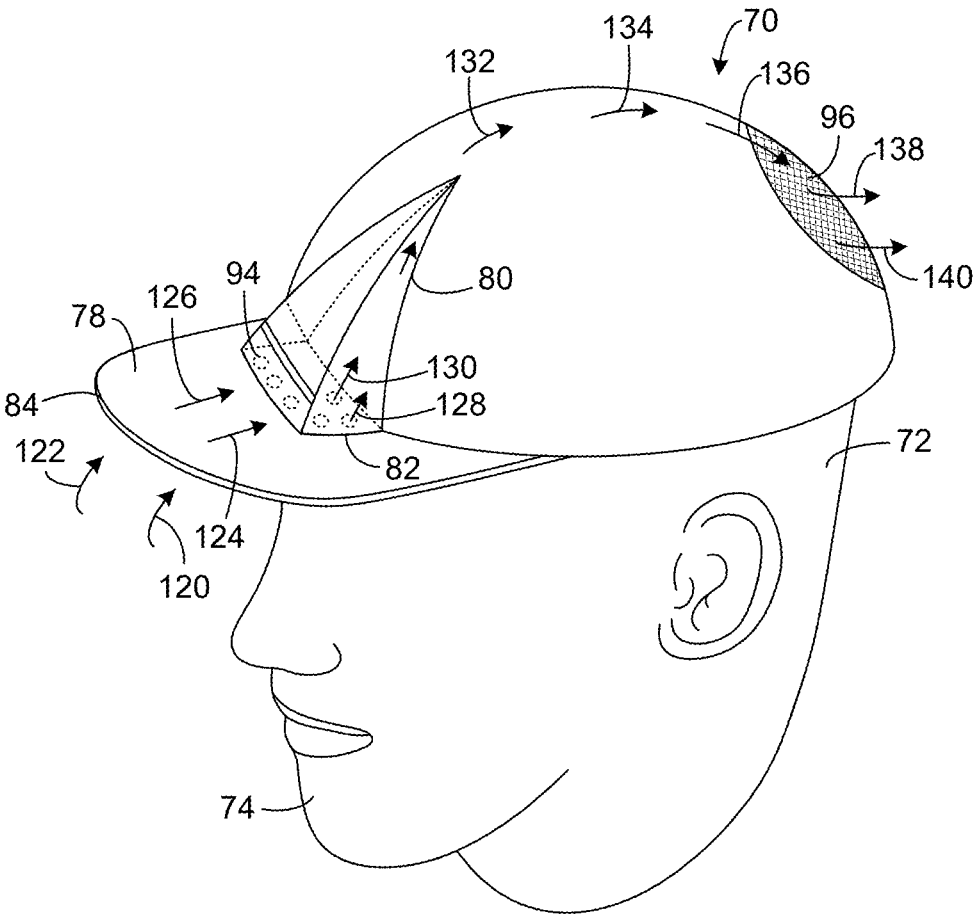
FIG. 8 is an upper perspective view of the headwear of the present invention as applied to a head of a wearer and showing, in particular, arrows indicating the nature of air flow circulation through the headwear.

FIG. 8 shows, in particular, the airflow circulation. As can be seen by the arrows 120 and 122 air flow is directed toward the underside 92 of the visor 78. This can be accomplished by a normal breeze or wind or by the movement of the wearer 74. Similarly, arrows 124 and 126 illustrate air flow circulation across the top 84 of the visor 78. The air flow represented by arrows 124 and 126 will enter the holes 94 and/or also enter the holes 90 so as to flow upwardly through the insert member 80. This is represented by arrows 128 and 130. The air flow represented by arrows 128 of 130 continues to flow upwardly so as to circulate over the head 72 of the wearer 74. This is shown by arrows 132, 134 and 136. Ultimately, this air flow will escape from the headwear 70 through the vent 70 or 96. This is illustrated by arrows 138 and 140.

The present invention is in the nature of a baseball cap composed of panels that are sewn together so as to form a semi-spherical crown and a visor which extends from the front of the crown. In the first embodiment of the present invention, air flow and evaporation are promoted by a pair of openings or ports. One of the ports is on the frontal part of the cap and the other opening is on the rearward portion of the cap. These ports are created by allowing a portion of the front and rear of the cap to swing open so as to create its own visor. These visors are inserts covered in cloth, similar to that of the main visor on the front of the cap.

These port openings can have padded material so as to cover the port frame. This facilitates the attachment of the opening mechanism and provides comfort to the user. These port mechanisms may be articulated joints, hinges or snap systems. As such, it allows for different apertures and different types of air flow. The ports also have the option of collapsible walls that further enhance the wind tunnel effect. The ports can also have detachable screens in order to keep insects and other pests out of the interior of the cap.

Front port is larger than the rear port. Each port has a visor which allows air flow and shade. When used while running, the front and rear ports (with collapsible walls) create the wind tunnel effect that allows for air flow and evaporation. The adjustable visors rest on the front and rear of the cap when not actuated and conform to the shape of the cap. As such, it will appear aesthetically similar to other caps.

In the alternative embodiment of the present invention, air is induced into the cap from an opening underneath the visor next to the forehead and then through a duct (which may also have openings) and arrive at the forehead of the wearer through a partial or complete opening on the front of the cap. The transition piece from the visor to the front of the cap or duct can be of any shape or material. It can also be permanent or detachable. In this alternative embodiment, there is a rear vent that is formed of a perforated cloth.

The foregoing disclosure and description of the invention is illustrative and explanatory thereof. Various changes in the details of the illustrated construction can be made is the scope of the present invention without departing from the true spirit of the invention. The present invention should only be limited by the following claims and their legal equivalents.

The invention claimed is:

1. A headwear comprising:

a crown adapted to fit upon a head of the wearer;

a visor affixed to said crown so as to extend forwardly of said crown; and an insert member affixed to said crown, said insert member having an airflow port formed thereon, the airflow port adapted to allow air to flow to an interior of said crown and to circulate over the head of the wearer, said insert member having a spacer portion arranged at the interior of said crown so as to space said crown from the head of the wearer, said insert member comprising:

a front insert member positioned of the forward portion of said crown; and a back insert member positioned at a rearward portion of said crown, wherein each of the front insert member and the back insert member has the airflow port formed therein, said front insert member and said back insert member adapted so as to allow air flow to enter said front insert member and to pass around the head of the wearer toward said back insert member, wherein the airflow port at the forward portion of said crown has a larger area than an area of the airflow port at the rearward portion of said crown.

2. The headwear of claim 1, said insert member being positioned at a forward portion of said crown.

3. The headwear of claim 1, wherein each of said front insert member and said back insert member is covered with a cloth.

4. The headwear of claim 3, wherein the cloth exposes the airflow port of said front insert member and said back insert member.

5. The headwear of claim 1, wherein said insert member is formed of a plastic material.

6. A headwear comprising:

a crown adapted to fit upon a head of the wearer;

a visor affixed to said crown so as to extend forwardly of said crown; and an insert member affixed to said crown, said insert member having an airflow port formed thereon, the airflow port adapted to allow air to flow to an interior of said crown and to circulate over the head of the wearer, said insert member having a spacer portion arranged at the interior of said crown so as to space said crown from the head of the wearer, wherein said insert member has a cover thereon, the cover being movable between an open position and a closed position.

7. The headwear of claim 6, wherein the cover of the insert member defines an opening in the open position, the opening communicating with the interior of said crown adapted to allow air to pass toward the head of the wearer.

8. The headwear of claim 7, wherein the cover is hingedly connected to said insert member or to said crown.

9. The headwear of claim 7, further comprising:

a screen connected to the cover of said insert member so as to extend across the opening when the cover is in the open position.

10. The headwear of claim 9, wherein said screen is detachably affixed to the cover of said insert member.

11. The headwear of claim 6, wherein the cover of said insert member has a triangular-shaped with a wide end positioned adjacent to the visor, the cover covering the airflow port in the closed position.

12. The headwear of claim 6, wherein the cover of said insert member has a generally rectangular shape that covers at least a portion of the airflow port of said insert member in the closed position.

13. A headwear comprising:

a crown adapted to fit upon a head of the wearer;

a visor affixed to said crown so as to extend forwardly of said crown; and an insert member affixed to said crown, said insert member having an airflow port formed thereon, the airflow port adapted to allow air to flow to an interior of said crown and to circulate over the head of the wearer, said insert member having a spacer portion arranged at the interior of said crown so as to space said crown from the head of the wearer, wherein said insert member has the airflow port at or adjacent to said visor, the airflow port allowing air to enter the interior of said crown, wherein said insert member has a generally rectangular shape with a wide end at or adjacent to said visor in a narrow and approaching a top of said crown.

14. The headwear of claim 13, wherein said visor has a plurality of holes formed therethrough, the plurality of holes opening to a bottom of said insert member, the plurality of holes adapted to allow air to enter the interior of said crown and to pass through the interior of said insert member from a bottom of said visor.

15. The headwear of claim 13, wherein said insert member has a plurality of holes formed at or adjacent to the bottom of said insert member, the plurality of holes adapted to allow air to enter the interior of said crown from the bottom of said insert member.

16. The headwear of claim 13, wherein said crown has a vent formed at a back of said crown, the vent opening to the interior of said crown.

17. The headwear of claim 16, wherein said vent is formed of a netted material.

* * * * *